US008876498B2

(12) United States Patent
Grimes

(10) Patent No.: US 8,876,498 B2
(45) Date of Patent: Nov. 4, 2014

(54) PUMPS AND PUMP-HEADS WITH SEPARATELY REMOVABLE FIELD-SERVICEABLE PORTION

(75) Inventor: David J. Grimes, Beaverton, OR (US)

(73) Assignee: Micropump, Inc., Vancouver, WA (US)

( * ) Notice: Subject to any disclaimer, the term of this patent is extended or adjusted under 35 U.S.C. 154(b) by 455 days.

(21) Appl. No.: 13/302,741

(22) Filed: Nov. 22, 2011

(65) Prior Publication Data

US 2012/0128514 A1 May 24, 2012

Related U.S. Application Data

(60) Provisional application No. 61/458,463, filed on Nov. 22, 2010.

(51) Int. Cl.

| | |
|---|---|
| ***F04B 17/00*** | (2006.01) |
| ***F04C 2/10*** | (2006.01) |
| ***F04B 17/04*** | (2006.01) |
| ***F04C 2/08*** | (2006.01) |
| *F04C 29/00* | (2006.01) |

(52) U.S. Cl.

CPC . *F04B 17/04* (2013.01); *F04C 2/10* (2013.01); *F04C 2230/70* (2013.01); *F04C 29/0064* (2013.01); *F04C 2240/805* (2013.01); *F04C 2/086* (2013.01)

USPC ..... 417/420; 417/410.4

(58) Field of Classification Search

USPC ..... 417/410.4, 420

See application file for complete search history.

(56) References Cited

U.S. PATENT DOCUMENTS

| | | | | |
|---|---|---|---|---|
| 3,238,883 | A | 3/1966 | Martin | |
| 3,240,158 | A | 3/1966 | Brundage | |
| 3,716,306 | A * | 2/1973 | Martin et al. | 417/44.4 |
| 5,702,234 | A * | 12/1997 | Pieters | 417/53 |
| 2004/0253119 | A1 | 12/2004 | Hunsberger | |
| 2009/0056124 | A1 * | 3/2009 | Krebs et al. | 29/888.025 |
| 2009/0060728 | A1 * | 3/2009 | Grimes et al. | 415/200 |

FOREIGN PATENT DOCUMENTS

| | | | |
|---|---|---|---|
| DE | 10 2007 054 544 | A1 | 6/2008 |
| DE | 10 2008 034 176 | A1 | 1/2010 |
| DE | 20 2010 011 626 | U1 | 10/2010 |
| EP | 2 078 859 | A2 | 7/2009 |
| WO | WO 97/20143 | A1 | 6/1997 |

OTHER PUBLICATIONS

International Search Report from corresponding International App. No. PCT/US2011/061901, mailed Jun. 5, 2013, 4 pages.

* cited by examiner

*Primary Examiner* — Peter J Bertheaud
*Assistant Examiner* — Dominick L Plakkoottam
(74) *Attorney, Agent, or Firm* — Klarquist Sparkman, LLP

(57) ABSTRACT

An exemplary pump-head includes a pump housing having first and second housing portions forming a pump-cavity and a magnet-cavity. The pump-cavity contains a movable pumping element, and the magnet-cavity contains a driven magnet coupled to the movable pumping element. The magnet is driven by a moving external magnetic field, which correspondingly moves the pumping element in the pump-cavity in a pumping manner. The second housing portion has inlet and outlet ports and defines at least respective portions of the magnet-cavity and pump-cavity. The first housing portion is detachable from the second housing portion to allow the pumping element to be accessed and carried away with the first housing portion, without disturbing the second housing portion.

18 Claims, 7 Drawing Sheets

PUMPS AND PUMP-HEADS WITH SEPARATELY REMOVABLE FIELD-SERVICEABLE PORTION

CROSS-REFERENCE TO RELATED APPLICATION

This application claims priority to, and the benefit of, U.S. Provisional Patent Application No. 61/458,463, filed on Nov. 22, 2010, which is incorporated by reference herein in its entirety.

FIELD

This disclosure pertains to, inter alia, gear pumps and other pumps configured to operate in a substantially primed condition to urge flow of a liquid. The subject pumps and pump-heads include various types having one or more rotary members, such as meshed gears, or at least one pumping member that operates continuously in a cyclic manner, such as a piston.

BACKGROUND

Several types of pumps are especially useful for pumping liquids and other fluids with minimal back-flow and that are amenable to miniaturization. An example is a gear pump, another example is a piston pump, and a third example is a variation of a gear pump in which the rotary pumping members have lobes that interdigitate with each other. Gear pumps and related pumps have experienced substantial acceptance in the art due to their comparatively small size, quiet operation, reliability, and cleanliness of operation with respect to the fluid being pumped. Gear pumps and related pumps also are advantageous for pumping fluids while keeping the fluids isolated from the external environment. This latter benefit has been further enhanced with the advent of magnetically coupled pump-drive mechanisms that have eliminated leak-prone hydraulic seals that otherwise would be required around pump-drive shafts.

Gear pumps have been adapted for use in many applications, including applications requiring extremely accurate delivery of a fluid to a point of use. Consequently, these pumps are widely used in medical devices and scientific instrumentation. Developments in many other areas of technology have generated new venues for accurate pumps and related fluid-delivery systems. Such applications include, for example, delivery of liquids in any of various automotive applications.

Automotive applications are demanding from technical, reliability, and environmental viewpoints. Technical demands include spatial constraints, ease of assembly and repair, and efficacy. Reliability demands include requirements for high durability, vibration-resistance, leak-resistance, maintenance of hydraulic prime, and long service life. Environmental demands include internal and external corrosion resistance, and ability to operate over a wide temperature range.

Most moving parts of gear pumps and related types of pumps, as summarized above, are naturally subject to wear. If allowed to progress excessively, wear can degrade the operational accuracy, reliability, and/or usability of the pump. Consequences of wear can be reduced in some instances by performing preventative maintenance of the pump, which can include replacement of parts that have experienced at least a threshold amount of wear. Scheduled preventative maintenance can be an important aspect of prolonging the usable life of the pump. Also, in a given population of pumps, especially pumps experiencing hard use, it is natural for at least a few to require an unscheduled maintenance or repair activity to keep them running or running properly.

A maintenance activity on a conventional gear-pump head, for example, typically requires at least: (1) disconnection and removal of the pump assembly from its hydraulic circuit in the host system, (2) disconnection of the pump assembly from electrical power, (3) removal of the pump from the host system, and (4) disassembly of the pump head to gain access to the moving parts (e.g., the gears) inside. These tasks can be difficult to perform even under the best of conditions, such as in a repair facility manned by skilled personnel, and are particularly difficult to perform in the field or on location. For example, the culprit pump may be: (a) situated in a substantially inaccessible location in the host system, (b) difficult to disconnect hydraulically, electrically, and/or mechanically from the host system, (c) difficult to keep clean once opened, and/or (d) constructed such that the subject parts are easily lost or damaged during the maintenance activity.

Alternatively to removing and disassembling the pump head in the field, conventional field maintenance of the pump may involve simply disconnecting and detaching the pump assembly from the host system and replacing the pump with a new one. This approach can be unacceptably expensive because the entire pump assembly is replaced even though only a part of it actually needs replacement. This approach does not usually save much time because the pump assembly must be entirely disconnected and removed, followed by mounting and connecting the replacement pump.

An exemplary "in the field" use of a gear pump or related type of pump is in or on a motor vehicle. As noted above, automotive applications are inherently "extreme duty" applications for pumps at least in part because of the mobility of the vehicle. Motion of the vehicle subjects the pump to large amounts of vibration and possibly other physical impacts, and mobility allows the vehicle to be in any of a wide variety of environmental circumstances and physical locations (including remote locations). Consequently, maintenance or repair of the pump may need to be performed on location under very difficult conditions. In other words, "in the field" could be substantially anywhere accessible by the vehicle.

The useful life of a motor vehicle is usually longer than the usable life of most pumping elements. Also, the performance demands imposed on gear pumps and related types of pumps mounted on motor vehicles are progressively becoming more severe, which results in progressively greater loads being applied to the pumping elements. Increasing the load increases wear. Therefore, it is more probable that such a pump will be the subject of at least one maintenance activity performed in the field.

As in motor-vehicle applications, many other applications of gear pumps and related types of pumps are characterized by progressively increased performance demands imposed on the pump, difficulty of access to the pump for maintenance activity, difficulty of shutting down the host system for the time needed to perform the maintenance activity, and difficulty of performing the maintenance activity on location. An example increased performance demand is higher pump-outlet pressure, which typically causes more rapid wear of certain parts and surfaces inside the pump-head.

Therefore, there is a need for pumps and pump heads that are more easily and quickly serviced or otherwise subjected to an activity involving opening up the pump head on location, such as in the field. There is also a need for pumps and pump heads that allow simplified replacement of wearing or worn components without having to replace the entire pump.

SUMMARY

The needs summarized above are met by pump-heads according to the invention. An exemplary embodiment of such a pump-head comprises a pump housing comprising a discrete first housing portion and a discrete second housing attached together to define a pump-cavity and a magnet-cavity in hydraulic communication with the pump-cavity. The pump-cavity contains at least one movable pumping element, and the magnet-cavity contains a driven magnet coupled to the movable pumping element and magnetically coupled to a moving magnetic field produced outside the pump housing. Movement of the magnetic field causes corresponding movement of the driven magnet, which causes corresponding motion of the pumping element in the pump-cavity in a manner resulting in a pumped flow of liquid through the pump-cavity. The second housing portion comprises inlet and outlet ports in hydraulic communication with the pump-cavity. The second housing portion defines at least a portion of the magnet-cavity and at least a portion of the pump-cavity. The first housing portion is detachable from the second housing portion to open the pump-cavity and allow the at least one pumping element to be carried away with the detached first housing portion, thereby providing access to the at least one pumping element without disturbing the second housing portion. As used herein, "without disturbing" the second housing portion means, for example, without having to disconnect the second housing portion electrically or hydraulically from its current installation situation. Thus, "wearable" components and surfaces (i.e., components and surfaces of the pump head most likely to require service or replacement due to wear) are readily serviced in the field quickly and easily with minimal invasion of portions of the pump-head not requiring service.

The first and second housing portions are attached to each other using any of various fasteners to form the pump housing. The fastener(s) can be associated with one or both housing portions. By way of example, and in a particularly advantageous embodiment, the fastener is an integral fastener that comprises a threaded region on the first housing portion and a complementarily threaded region on the second housing portion. By these threaded regions the first housing portion is threaded to the second housing portion to form the pump housing. For example, the threaded region on the first housing portion is male, while the threaded region on the second housing portion is female.

The pump-head desirably further comprises a static seal situated between the first and second housing portions to seal the pump housing whenever the first and second housing portions are fastened together. By way of example, the static seal is seated on the first housing portion so as to engage a mating surface on the second housing portion to seal the pump housing whenever the first and second housing portions are fastened together.

In some embodiments the at least one pumping element comprises a driving gear and a driven gear enmeshed with the driving gear. The gears are rotatably attached to the first housing portion and are situated in the pump-cavity. The driven magnet is situated in the magnet-cavity and is coupled to the driving gear so as to co-rotate with the driving gear. The driven magnet is rotatable, when urged by an external moving magnetic field, about a rotational axis. This rotation causes corresponding rotation of the driving gear and corresponding contra-rotation of the driven gear in the pump-cavity.

Since the gears are generally regarded as "wearable" components, the driving gear and driven gear desirably are rotatably attached to the first housing portion such that the first housing portion, as detached from the second housing portion, includes at least the gears.

The driving gear in the pump-cavity can include an axial shaft and a first portion of an axial coupling connected to the driving gear. Meanwhile, the driven magnet in the magnet-cavity includes an axial bore and a second portion of an axial coupling. Whenever the first and second housing portions are attached to each other, the axial shaft is inserted into the axial bore, allowing mutual engagement of the first and second portions of the axial coupling such that rotation of the driven magnet about its axis causes rotation of the axial shaft and thus of the driving gear in the pump-cavity. Desirably, the axial shaft and first portion of the axial coupling come away with the first housing portion whenever the first housing portion is detached from the second housing portion.

The magnet-cavity can be configured to retain the driven magnet in the magnet-cavity whenever the first housing portion is detached from the second housing portion. Especially if the driven magnet is a wearable component, the first housing portion can be configured so that the driven magnet is drawn out of the magnet-cavity and comes away with the first housing portion whenever the first housing portion is detached from the second housing portion. In many embodiments the magnet-cavity has thin walls and is configured for coaxial disposition relative to a stator or other source of a moving magnetic field situated outside the magnet-cavity. A stator is configured to produce the moving magnetic field without having to use moving parts. The stator is magnetically coupled to the driven magnet inside the magnet-cavity. The thin walls are easily traversed by the magnetic field produced by the stator so that the magnetic field can be coupled to the driven magnet.

The foregoing and additional features and advantages of the subject methods will be more readily apparent from the following detailed description, which proceeds with reference to the accompanying drawings.

DETAILED DESCRIPTION

Figure 1B:
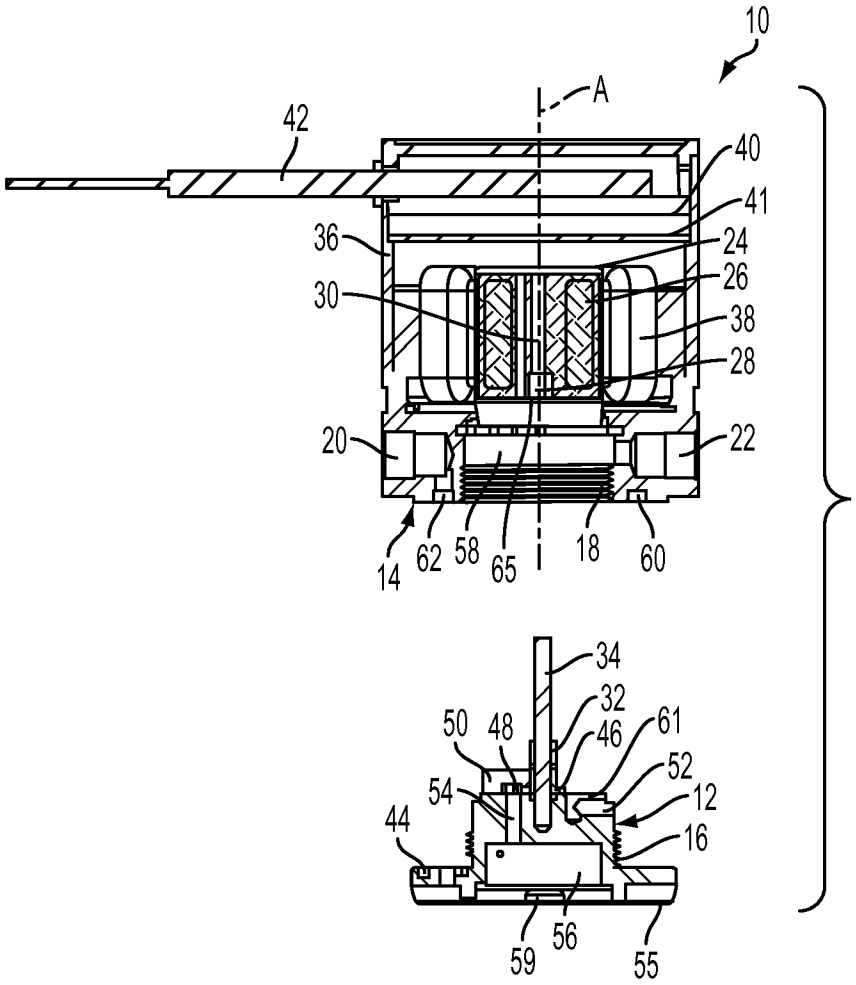
FIGS. 1A-1B depict an orthogonal elevational view and a corresponding elevational section, respectively, of a representative embodiment of a gear pump-head of which the first housing portion has been removed from the second housing portion.

The exemplary embodiments described herein are not intended to be limiting in any way. This disclosure is directed toward all novel and non-obvious features and aspects of the disclosed embodiments, alone and in various combinations and sub-combinations with one another. The disclosure is not limited to any specific aspect or feature or combinations thereof, nor does the disclosure require that any one or more specific advantages be present or problems be solved.

As used herein, the singular forms "a," "an," and "the" include the plural forms unless the context clearly dictates otherwise. Additionally, the term "includes" means "comprises." Further, the term "coupled" encompasses mechanical as well as other practical ways of coupling or linking items together, and does not exclude the presence of intermediate elements between the coupled items.

In the disclosure, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

A representative embodiment comprises a pump-head for a gear pump. A "pump-head" is an assembly including a pump housing, a pump element disposed in the pump housing, at least one inlet, and at least one outlet. The inlet and outlet are in hydraulic communication with the pump housing. The "pump element" is drivable (e.g., rotatable or otherwise movable) relative to the housing a suitable "mover" (e.g., an electric motor), wherein such movement of the pump element urges flow of the fluid through the housing from the inlet to the outlet. A "pump" is a pump head including the mover. In a pump-head for a gear pump, the pump element comprises at least two intermeshed gears located in a gear cavity defined by the housing. Driving one of the gears (termed the "driving gear") to rotate about its axis produces a corresponding opposite-direction rotation of the other gear (termed the "driven gear). I.e., the gears "contra-rotate" relative to the gear cavity. Contra-rotation of the gears produces an elevated pressure condition that urges flow of the fluid through the pump housing from the inlet to the outlet. Typically, the pressure condition is one in which the pressure in the outlet has been increased relative to the pressure in the inlet as a result of the pump element being driven. The "inlet" is a feature of the pump housing by which fluid enters the pump housing, and the "outlet is a feature of the pump housing by which fluid exits the housing. Gear pumps are particularly useful if the fluid being pumped thereby is a liquid.

Gear pumps as disclosed herein are magnetically driven, which eliminates the need for a dynamic seal between the mover and the pump-head. More specifically, the pump head contains a permanent magnet that serves as a "driven magnet." The driven magnet, usually cylindrical and rotatable about its cylindrical axis, is coupled to the driving gear such that rotation of the driven gear causes the driving gear to rotate at an equal angular velocity. The permanent magnet is contained in a portion of the pump housing called a "magnet-cavity." Since the driven magnet is cylindrical, the magnet-cavity is cylindrical, with an inside diameter and length slightly greater than the outside diameter and length, respectively, of the driven magnet. The magnet-cavity is in hydraulic communication with the gear cavity, and thus contains some of the liquid being pumped by the pump-head.

In other embodiments the subject pump-head is for a piston pump, or other type of pump comprising a moving pump element that can be situated in a pump-cavity and coupled to a driven magnet.

In some embodiments, the driven magnet is magnetically coupled to a second magnet (called a "driving magnet") located outside the pump housing coaxially with the driven magnet. The driving magnet is mounted, for example, on the armature of a motor such that rotation of the armature about its axis correspondingly rotates the driving magnet about its axis. The resulting axially rotating magnetic field produced by the rotating driving magnet causes corresponding rotation of the driven magnet about its axis.

In a more compact arrangement, the driving magnet is eliminated, and the magnet-cavity is axially surrounded by a stator or the like that is magnetically coupled to the driven magnet. The stator is located outside the magnet-cavity, coaxially with the magnet-cavity and driven magnet. The stator is electrically energized in a manner that causes the stator to produce a rotating magnetic field, which causes corresponding rotation of the driven magnet.

A pump-head according to many embodiments comprises a first housing portion and a second housing portion. The first housing portion is attached to (but detachable from) the second housing portion. The first housing portion includes pump components and surfaces that experience the most wear (e.g., the pump gears and surfaces of the gear cavity against which they rotate) and hence are most likely to require a maintenance activity requiring access to the components. During a maintenance activity, the first housing portion (with its respective components) is easily removable from the second housing portion and either serviced under more convenient conditions in the field or simply replaced on the spot. Thus, the first housing portion with its respective pump components can be regarded as a "replaceable" part of the pump-head. The second housing portion includes components and surfaces that typically require less maintenance and typically also include the inlet and outlet ports for the pump-head. Whenever the first housing portion is attached to the second housing portion, the pump-head is operable in a normal manner. Detaching the first housing portion from the second housing portion normally does not require electrical or hydraulic disconnection of the second housing portion and normally does not require removal of the second housing portion from its mounting. The first housing portion may also include a filter element or other component(s) requiring a maintenance activity (e.g., periodic replacement or cleaning) during the life of the pump or machine or vehicle to which the pump is mounted.

In an embodiment configured as a gear pump the second housing portion includes the magnet-cavity, which contains the "driven" magnet as discussed above. Outside the magnet-cavity is either a "driving" magnet or coaxial stator. The second housing portion also includes at least one inlet port and at least one outlet port. These ports are hydraulically coupled to the gear cavity whenever the first housing portion is attached to the second housing portion. The first and second housing portions attached together also collectively define the gear cavity. Thus, the first housing portion defines at least a portion of the gear cavity (namely, the most wearable portion). At least one driving gear and one driven gear are rotatably mounted and enmeshed with each other in the gear cavity. The gears are rotatably mounted to the first housing portion in a manner such that, whenever the first housing portion is removed from the second housing portion, the gears remain attached to and come away with the first housing portion. The first housing portion, either alone or in cooperation with the second housing portion, defines fluid passageways that hydraulically connect the gear cavity with the inlet and outlet ports, respectively, on the second housing portion. The first housing portion also includes, if desired or required, a respective suction shoe for at least one of the gears.

The first and second housing portions desirably are configured in a manner allowing quick and easy attachment and detachment of the first housing portion from the second housing portion. Thus, the first and second housing portions are termed "discrete" because of their ability to be disassembled from and separated from each other. By way of example, the first housing portion is threaded into the second housing portion to attach the first housing portion to the second housing portion. This conveniently allows use of a single tool (e.g., wrench) and a single action (turning the wrench when fitted to the first housing portion) for removal of the first housing portion from the second housing portion (and for attachment of the first housing portion to the second housing portion.

The pump can be, by way of example, a gear pump or a piston pump; but, it will be understood that these specific pumps are not intended to be limiting. Various other specific types of magnetically driven pumps can be configured such that the wearing components are replaceable without requiring the whole of the assembly to be interchanged.

Performing pump maintenance by removing and/or replacing the first housing portion while leaving the second housing portion in situ reduces overall pump and system costs because the maintenance activity does not involve replacement of or rebuilding the entire pump; rather, only the most wearable portions of the pump-head are removed and subjected to the maintenance activity. Also, pump-heads according to the invention alleviate any conventionally perceived need to fabricate the most wearable components and surfaces of exotic, and hence costly, materials. In addition, service costs are reduced because maintenance generally requires that only the first housing portion be removed, and the removal can be quickly achieved using one tool.

Figure 1A:
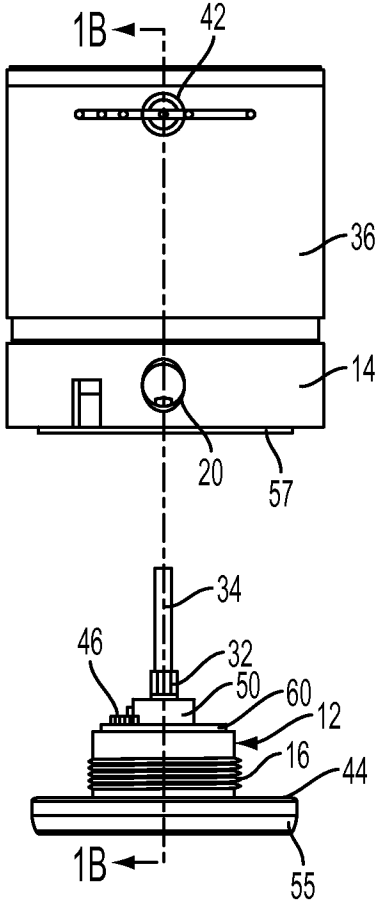
Figure 2C:
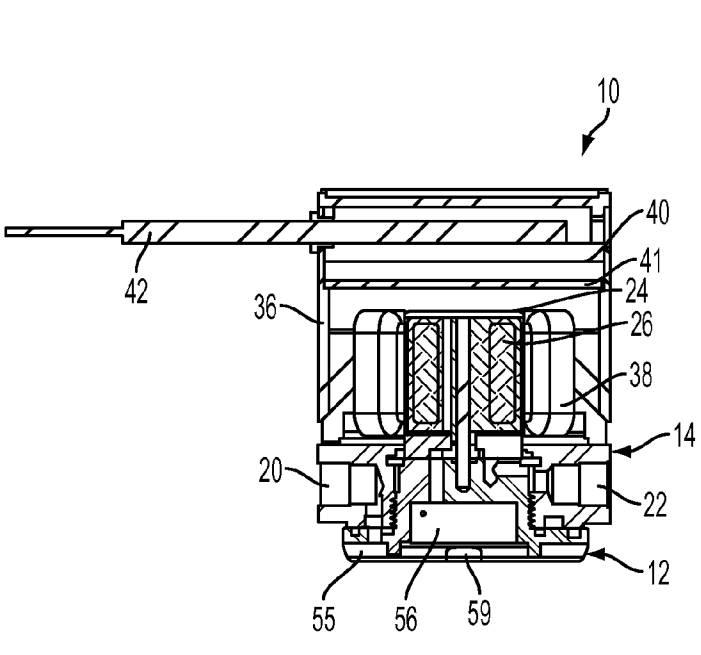
FIG. 2C is an elevational section of the assembled first representative embodiment.
Figure 2B:
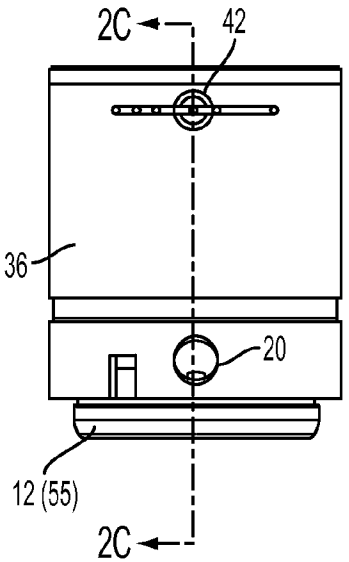
FIG. 2B is an orthogonal view of the first representative embodiment in which the first housing portion has been assembled to the second housing portion.
Figure 2A:
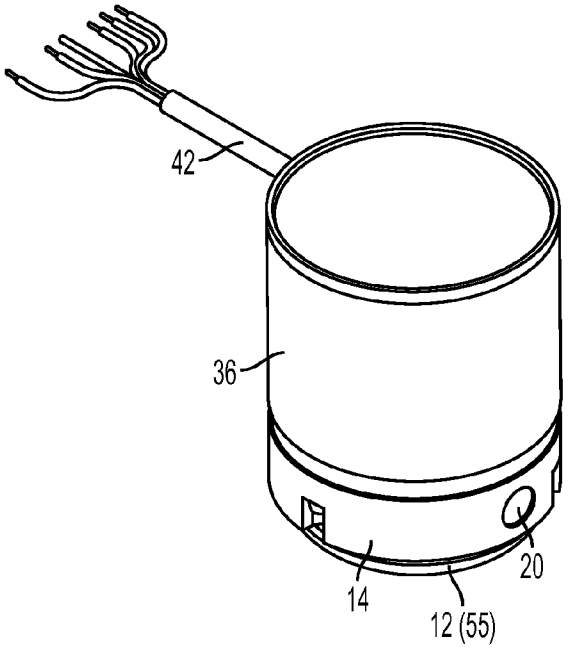
FIG. 2A is a perspective view of the first representative embodiment in which the first housing portion has been assembled to the second housing portion.

A representative embodiment is shown in FIGS. 1A-1B and 2A-2C. FIGS. 1A and 1B depict an orthogonal and corresponding sectional view of a gear pump-head 10. FIG. 2A provides a perspective view of the pump-head 10 in an assembled condition, and FIGS. 2B and 2C depict orthogonal and corresponding sectional "exploded" views in which the first housing portion 12 and second housing portion 14 are separated from each other. The first housing portion 12 has a male thread 16 (FIGS. 1A and 1B) and the second housing portion 14 has a female thread 18 (FIG. 1B), by which the first and second housing portions are threaded together. These male and female threads 16, 18 are exemplary of an integral "fastener" being used to fasten the first housing portion 12 to the second housing portion 14 to form the pump housing.

The second housing portion 14 includes an inlet port 20 and an outlet port 22 (FIGS. 1B and 2C). The second housing portion 14 also includes a magnet cavity 24 (FIGS. 1B and 2C) containing a driven magnet 26 that is rotatable about an axis A (FIG. 1B). Specifically, the magnet 26 is situated in a "magnet-cavity" defined by the magnet-housing 24. The magnet-cavity is continuously bathed by the liquid being pumped by the pump assembly 10. In this embodiment the driven magnet 26 includes a hex spline 28 and bore 30 (FIG. 1B) configured to receive a hex portion 32 and shaft 34 (FIG. 1A) on the first housing portion 12. Attached to the second housing portion 14 is a stator housing 36 (FIG. 2A) containing a stator 38 (FIG. 2C) arranged coaxially outside the magnet-cavity 24. The interior of the stator housing 36 is outside the second housing portion 14. Also contained in the stator housing 36 is a printed circuit board 40 (FIG. 1B) including electronics (not detailed) for energizing the stator 38. Power is supplied to the electronics by a cable 42 (FIGS. 1B and 2A). A partition 41 separates the portion of the stator housing 36 containing the printed circuit board 40 from the portion of the stator housing containing the stator 38 (FIG. 1B).

Between the first and second housing portions 12, 14 is a static seal (O-ring) 44 that seals the first and second housing portions together whenever the first housing portion 12 is fully threaded into the second housing portion 14. The hex portion 32 is axially affixed to a driving gear 46, which is meshed with a driven gear 48. The driven gear 48 is covered by a suction shoe 50 (FIGS. 1A and 1B). The first housing portion 12 also includes passageways 52 that connect the output region of the gears to the outlet port 22, and passageways 54 that connect the input region of the gears to the inlet port 20 (FIG. 1B). This embodiment also includes, in the first housing portion 12, an input cavity 56 (FIG. 1B) that, if desired, can accommodate a flow-through filter element, one or more sensors, and/or other useful component (not shown). The first housing portion 12 also includes a flange 55 (FIG. 1A) that is urged against a contact surface 57 of the second housing portion 14. The flange 55 in this embodiment includes the static seal 44. The flange 55 can also include, for example, a hex socket 59 (FIG. 2C) configured to receive a complementary-shaped tool (not shown) used for threading the first housing portion 12 into the second housing portion 14. Alternatively, the flange 55 can have opposing flats to accommodate a wrench, bores to accommodate a pin-wrench or snap-ring pliers, or be attachable and detachable using another type of fastener. For example, the first and second housing portions can be attached together using several bolts (not shown) arranged around and extending through the flange 55 into the second housing portion 14.

The second housing portion 14 also includes a first annular void 58 (FIG. 1B) that is hydraulically connected to the outlet port 22. Whenever the first and second housing portions are assembled together, the passageways 52 open into the first annular void 58 to conduct pumped liquid away from the gears to the outlet port 22. The second housing portion 14 includes a second annular void 60 (FIG. 1A) that is hydraulically connected to the inlet port 20. Whenever the first and second housing portions are assembled together, the inlet port 20 is connected via passageways 62 to the input cavity 56 to conduct liquid into the cavity 56 and then to the gears via the passageway 54. The assembled housing portions 12, 14 also collectively define the gear-cavity (not specifically identified in the figures) in which the gears 46, 48 are located in such a way that contra-rotation of the gears in the gear cavity urges flow of liquid from the inlet port 20 to the outlet port 22.

The first housing portion 12 is the "field-serviceable" portion of the pump assembly 10. As such, the first housing portion 12 includes the components most likely to experience significant wear during use, namely the gears 46, 48, suction shoe 50, and wearable surface 61. The second housing portion 14 includes components less likely to require maintenance or replacement, such as the magnet-cavity 24 and the driven magnet 26. These components are undisturbed by removing the first housing portion 12. Also undisturbed is the stator housing 36 and its contents (e.g., the stator 38 and the stator-driving electronics on the printed circuit board 40). At time of maintenance, the first housing portion 12 is simply unthreaded from the second housing portion 14. The serviceable component(s) remain attached to and come away with the first housing portion 12. (To prevent the driven magnet 26 from being disturbed during removal of the first housing portion, the magnet can be situated behind a partition 65 in the magnet-cavity 24. Alternatively, especially if the driven magnet is a component that may need maintenance during the lifetime of the pump assembly, the partition 65 can be omitted and the driven magnet allowed to come away with the first housing portion 12.) Note that the serviceable components on and in the first housing portion 12 are easily accessible after removing the first housing portion. A removed first housing portion 12 can be either replaced with a new one or serviced on the spot without having to disconnect the inlet and outlet ports 20, 22 from the hydraulic circuit in the host system, without having to remove the pump assembly 10 from the host system, and without having to disconnect the cable 42 from the host system (in other words, without disturbing the second housing portion 14 or anything connected to it).

Figure 3:
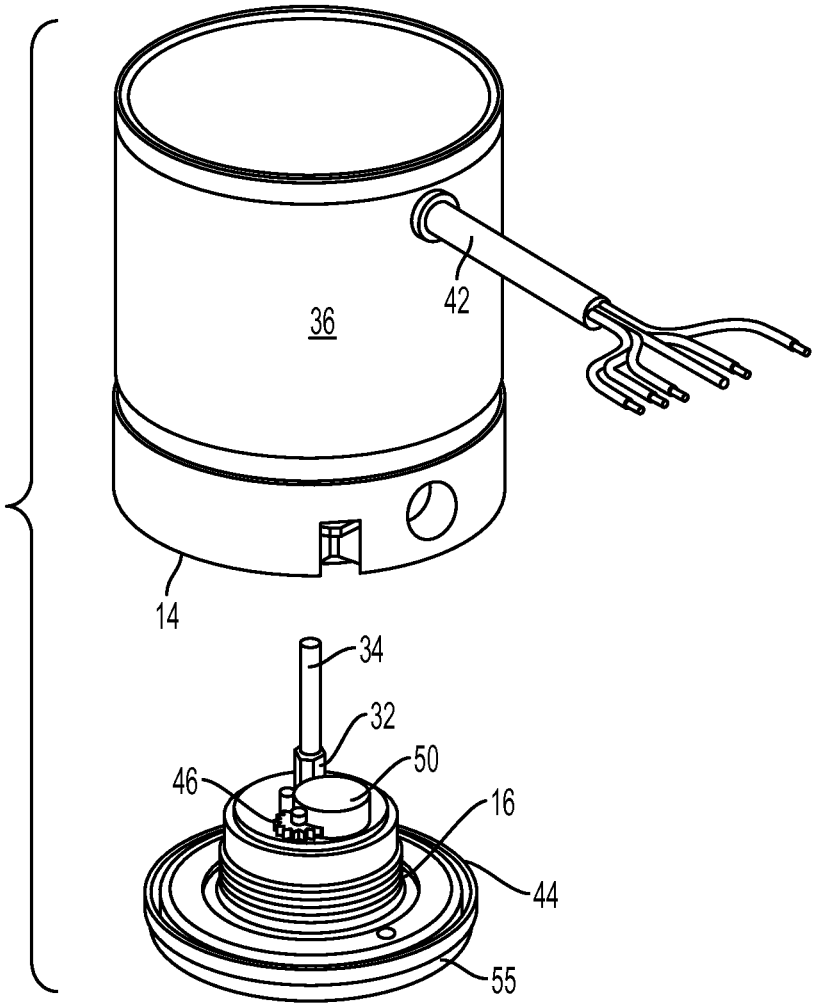
FIG. 3 is a perspective view of the first representative embodiment in which the first housing portion has been detached from the second housing portion, revealing surface detail especially of the first housing portion and its respective components.
Figure 4:
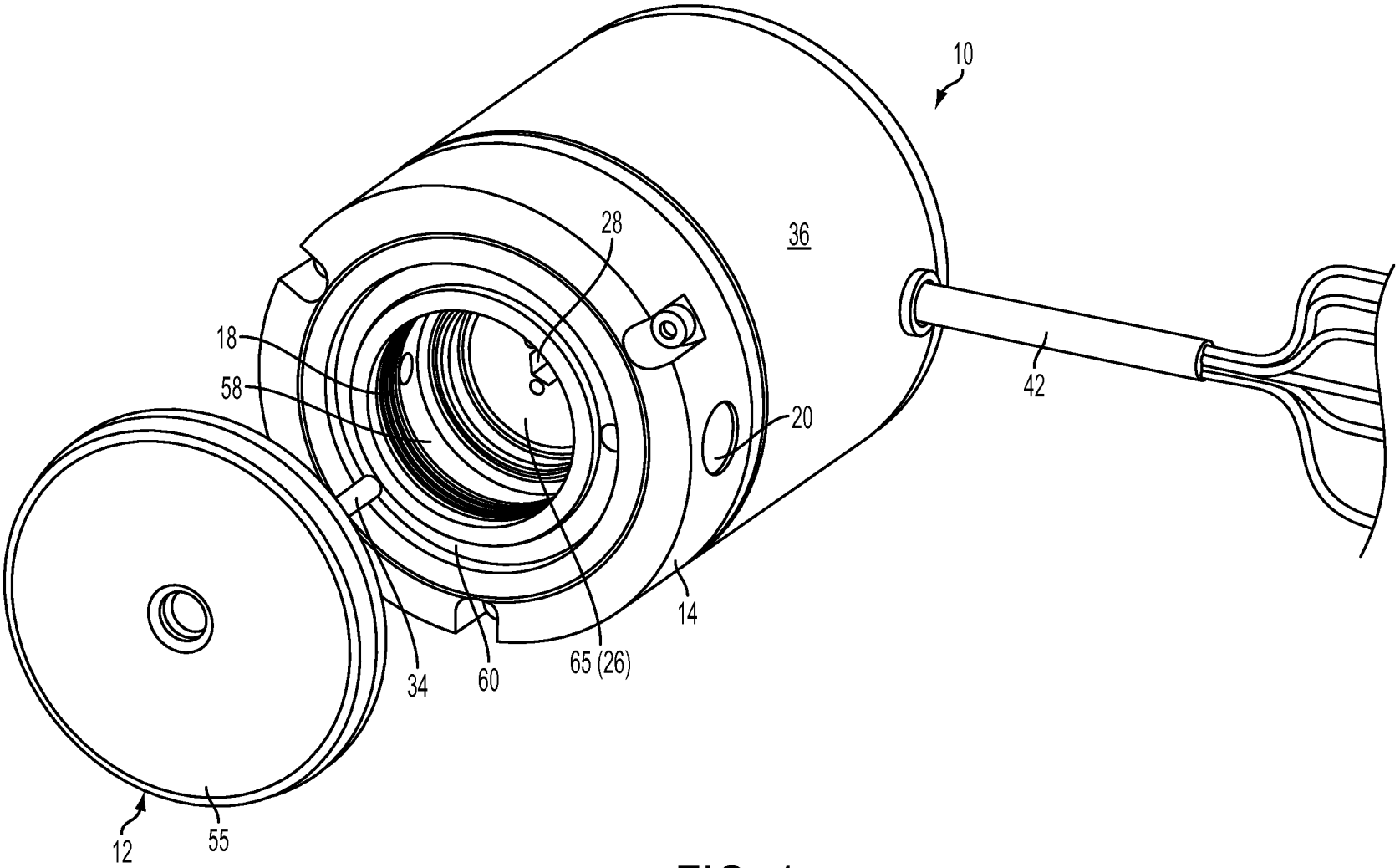
FIG. 4 is another perspective view of the first representative embodiment in which the first housing portion has been detached from the second housing portion, revealing surface detail inside the second housing portion.
Figure 5:
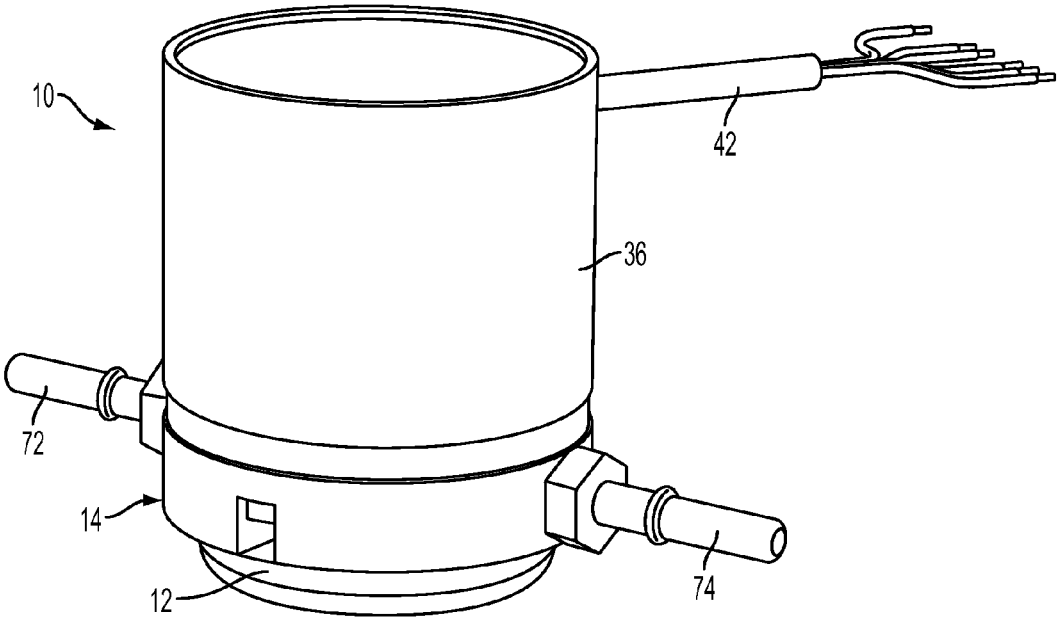
FIG. 5 is a perspective view of an embodiment of a pump assembly including respective fittings on the inlet and outlet ports.

FIG. 3 is a perspective drawing similar to the corresponding portion of FIG. 1, and provides surface detail especially of the first housing portion 12 and its respective components. FIG. 4 is another perspective drawing revealing surface detail inside the second housing portion 14, including the hex spline 28, the partition 65 for the magnet 26, the first annular void 58, and the second annular void 60. FIG. 5 depicts a pump assembly 10 including respective fittings 72, 74 on the inlet and outlet ports 20, 22.

Figure 6:
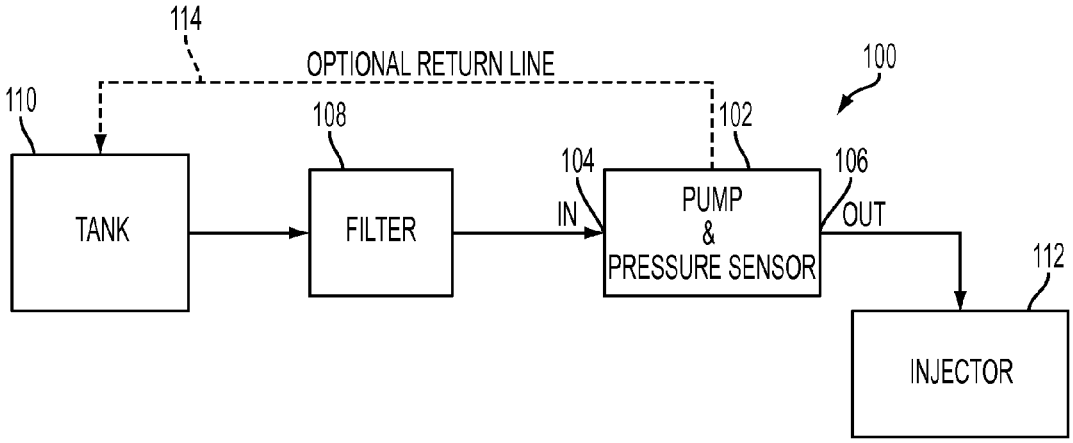
FIG. 6 is a schematic diagram of a second representative embodiment directed to a hydraulic circuit comprising a pump assembly such as the first representative embodiment.

A second representative embodiment is directed to a hydraulic circuit comprising a pump assembly such as that described above. The circuit 100 is shown in FIG. 6, which includes a pump assembly 102 having an inlet 104 and an outlet 106. The pump assembly 102 can include a pressure sensor or other type of hydraulically useful sensor (not shown). The inlet 104 is situated downstream of a filter 108, which is situated downstream of a tank 110 serving as a reservoir for liquid to be pumped by the pump assembly 102. The outlet 106 is hydraulically connected to a downstream injector 112 or other component from which pumped liquid is discharged from the circuit. If desired, the circuit 100 can include a return line 114 for returning liquid to the tank 110 that is not actually discharged from the injector 112.

The circuit 100 represents a circuit as used in an automotive application, in which the pump assembly 102 is subject to periodic preventative maintenance or to acute maintenance as required. As described above, at time of the maintenance activity, the first housing portion is simply removed from the second housing portion and serviced or replaced, without having to disconnect the second housing portion from the circuit.

Figure 7:
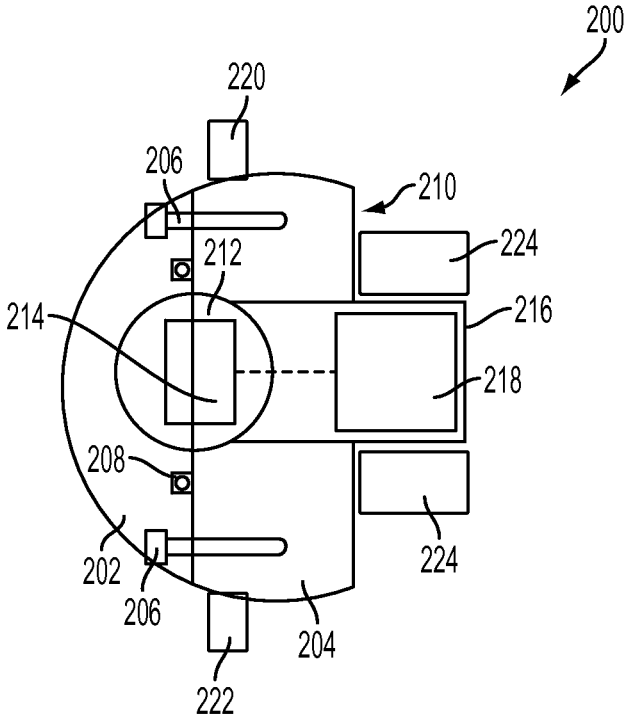
FIG. 7 is a schematic depiction of general features of an embodiment of a pump-head.

A schematic diagram of a pump head 200 is shown in FIG. 7, which depicts the first housing portion 202 and the second housing portion 204 being held together by bolts 206 and sealed using a static seal 208 to form a pump housing 210. The assembled portions 202, 204 collectively define the pump-cavity 212 containing the pumping element(s) 214. The first housing portion 202 defines its respective portion of the pump-cavity 212, while the second housing portion 204 defines its respective portion of the pump-cavity 212, such that detachment of the first housing portion 202 from the second housing portion 204 opens up the pump-cavity 212 and exposes the pumping element(s) 214 for maintenance of other purpose. The second housing portion 204 also defines, at least in part, the magnet-cavity 216 which contains the driven magnet 218. Detachment of the first housing portion 202 from the second housing portion 204 either decouples the magnet 218 from the pumping element(s) 214, leaving the magnet in the magnet-cavity 216 and hence in association with the second housing portion 204, or pulls the magnet 218 out of the magnet-cavity 216 with the first housing portion 202 as the first housing portion is pulled away from the second housing portion. The second housing portion 204 also includes at least one inlet 220 and at least one outlet 222. A stator 224 axially surrounds the magnet cavity 216.

Whereas the invention has been described in connection with representative embodiments, it will be understood that it is not limited to those embodiments. On the contrary, it is intended to encompass all alternatives, modifications, and equivalents as may be included within the spirit and scope of the invention as defined by the appended claims.

What is claimed is:

1. A pump-head, comprising:

a pump housing comprising a discrete first housing portion and a discrete second housing portion that, when attached together, define a pump-cavity and a magnet-cavity in hydraulic communication with the pump-cavity, the pump-cavity containing at least one movable pumping element, the magnet-cavity containing a driven magnet that is coupled to the movable pumping element and magnetically coupled to a moving magnetic field produced outside the pump housing, wherein movement of the magnetic field causes corresponding movement of the driven magnet, which causes corresponding motion of the pumping element in the pump-cavity in a manner resulting in a pumped flow of liquid through the pump-cavity;

the first housing portion having a first circumferential threaded region;

the second housing portion comprising inlet and outlet ports in hydraulic communication with the pump-cavity, the second housing portion defining at least a portion of the magnet-cavity and at least a portion of the pump-cavity, the second housing portion having a second circumferential threaded region that is complementary to the first circumferential threaded region so that the first and second housing portions are attachable together by one of the housing portions being threaded to the other housing portion to form the pump housing, and the housing portions when unthreaded from each other allowing the at least one pumping element to be carried away with the detached first housing portion, thereby providing access to the at least one pumping element without disturbing the second housing portion.

2. The pump-head of claim 1, wherein:

the pump-cavity comprises a wearable surface; and the wearable surface is exposed whenever the first housing portion is detached from the second housing portion.

3. The pump head of claim 2, wherein the wearable surface is on the first housing portion.

4. The pump-head of claim 1, further comprising a static seal situated between the first housing portion and the second housing portion to seal the pump housing whenever the first housing portion is attached to the second housing portion.

5. The pump-head of claim 1, wherein:

the first circumferential threaded region on the first housing portion is male; and the second circumferential threaded region on the second housing portion is female.

6. The pump-head of claim 5, further comprising a static seal situated between the first and second housing portions to seal the pump housing whenever the first and second housing portions are threaded together.

7. The pump head of claim 6, wherein the static seal is seated on the first housing portion so as to engage a mating surface on the second housing portion to seal the pump housing whenever the first and second housing portions are fully threaded together.

8. The pump-head of claim 1, wherein:

the at least one pumping element comprises a driving gear and a driven gear enmeshed with the driving gear, the gears being rotatably attached to the first housing portion and situated in the pump-cavity;

the driven magnet is situated in the magnet-cavity and is coupled to the driving gear so as to co-rotate with the driving gear; and the driven magnet is rotatable, when urged by an external moving magnetic field, about a rotational axis, which causes corresponding rotation of the driving gear and corresponding contra-rotation of the driven gear in the pump-cavity.

9. The pump-head of claim 8, wherein:

the driving gear and driven gear are rotatably attached to the first housing portion such that the first housing portion, as detached from the second housing portion, includes at least the gears; and the driving gear is coaxial with the first circumferential threaded region.

10. The pump-head of claim 9, further comprising a suction shoe associated with at least one of the gears, the suction shoe being attached to the first housing portion such that the first housing portion, as detached from the second housing portion, further includes the suction shoe.

11. The pump-head of claim 8, wherein:

the driving gear in the pump-cavity includes an axial shaft and a first portion of an axial coupling connected to the driving gear;

the driven magnet in the magnet-cavity includes an axial bore and a second portion of an axial coupling;

whenever the first and second housing portions are attached to each other, the axial shaft is inserted into the axial bore, allowing mutual engagement of the first and second portions of the axial coupling such that rotation of the driven magnet about its axis causes rotation of the axial shaft and thus of the driving gear in the pump-cavity; and the axial shaft and first portion of the axial coupling come away with the first housing portion whenever the first housing portion is detached from the second housing portion.

12. The pump-head of claim 11, wherein the pump-cavity is configured to retain the driven magnet in the magnet-cavity whenever the first housing portion is detached from the second housing portion.

13. The pump-head of claim 1, wherein the magnet-cavity is configured for coaxial disposition relative to a stator situated outside the magnet-cavity, the stator being configured to produce the moving magnetic field that is magnetically coupled to the driven magnet inside the magnet-cavity.

14. A pump, comprising:

a pump-head as recited in claim 1; and a magnet-rotation driver situated outside the magnet-cavity and magnetically coupled to the driven magnet such that energization of the magnet-rotation driver produces the moving magnetic field.

15. The pump of claim 14, wherein:

the at least one pumping element comprises a driving gear and a driven gear enmeshed with the driving gear, the gears being rotatably attached to the first housing portion;

the driving gear is coupled to the driven magnet to co-rotate with the rotating driving gear; and the driven magnet is rotatable, when urged by the moving magnetic field, about a rotational axis to cause corresponding rotation of the driving gear and corresponding contrarotation of the driven gear in the pump-cavity.

16. The pump of claim 15, wherein the magnet-rotation driver comprises a stator situated outside the magnet-cavity coaxially with the driven magnet situated inside the magnet-cavity, the stator being configured to produce the moving magnetic field that is magnetically coupled to the driven magnet inside the magnet-cavity.

17. The pump of claim 16, further comprising:

a stator housing attached to the pump housing and containing the stator; and a stator-drive circuit situated inside the stator housing.

18. A hydraulic circuit, comprising a pump as recited in claim 14.

* * * * *